US011732539B2

(12) United States Patent
Nguyen

(10) Patent No.: US 11,732,539 B2
(45) Date of Patent: Aug. 22, 2023

(54) ELECTRICALLY ACTIVATED WHIPSTOCK INTERFACE SYSTEM

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/508,243

(22) Filed: Oct. 22, 2021

(65) Prior Publication Data

US 2023/0125650 A1 Apr. 27, 2023

(51) Int. Cl.
*E21B 29/06* (2006.01)

(52) U.S. Cl.
CPC ..... *E21B 29/06* (2013.01)

(58) Field of Classification Search
CPC ..... E21B 29/06
See application file for complete search history.

(56) References Cited

U.S. PATENT DOCUMENTS 2,207,920 A 7/1940 Hughes
5,109,924 A 5/1992 Jurgens et al.
5,893,413 A 4/1999 Lembcke et al.
6,318,466 B1 * 11/2001 Ohmer ..... E21B 29/06 166/117.6
7,357,182 B2 * 4/2008 Hunt ..... E21B 43/114 166/50
11,421,496 B1 * 8/2022 Nguyen ..... E21B 7/061
2003/0183388 A1 10/2003 Toulouse et al.
2003/0205374 A1 11/2003 Toulouse et al.
2011/0203063 A1 8/2011 Atkins et al.
2015/0021029 A1 1/2015 Abrant et al.
2015/0090459 A1 4/2015 Cain et al.
2016/0145973 A1 5/2016 Lykkebo
2016/0230508 A1 8/2016 Jensen
2016/0305232 A1 10/2016 Bird et al.
2017/0067318 A1 3/2017 Haugland et al.
2017/0350203 A1 12/2017 Rud
(Continued)

FOREIGN PATENT DOCUMENTS

CN 107237612 A 10/2017
EP 1592865 B1 8/2007
(Continued)

OTHER PUBLICATIONS

International Search Report and Written Opinion dated Feb. 14, 2023 in PCT/US2022/046869; 11 pages.
(Continued)

*Primary Examiner* — Taras P Bemko
(74) *Attorney, Agent, or Firm* — Cantor Colburn LLP

(57) ABSTRACT

A window cutting system includes a whipstock connector, and a window mill selectively rotationally constrained to the whipstock connector. The window mill including an outer surface, an inner surface, a passage defined between the outer surface and the inner surface, and a recess formed in the outer surface. A locking pin is arranged in the recess. A motor arranged in the passage. An actuator is operatively connected between the motor and the locking pin. The motor being selectively activated through a signal to retract the locking pin releasing the window mill from the whipstock connector.

20 Claims, 14 Drawing Sheets

(56) References Cited

U.S. PATENT DOCUMENTS

| | | | | |
|---|---|---|---|---|
| 2018/0135372 | A1 | 5/2018 | Degeare et al. | |
| 2019/0003264 | A1* | 1/2019 | Swadi | E21B 29/002 |
| 2019/0106940 | A1* | 4/2019 | Korf | E21B 7/061 |
| 2019/0162046 | A1 | 5/2019 | Engevik et al. | |
| 2020/0190908 | A1* | 6/2020 | Pray | E21B 7/061 |
| 2021/0301615 | A1 | 9/2021 | Harrington et al. | |
| 2021/0372219 | A1* | 12/2021 | Brown-Kerr | E21B 7/061 |
| 2021/0381339 | A1* | 12/2021 | Taylor, Jr. | E21B 7/061 |
| 2022/0162920 | A1* | 5/2022 | Pray | E21B 23/00 |
| 2022/0268101 | A1* | 8/2022 | Pray | E21B 47/138 |

FOREIGN PATENT DOCUMENTS

| | | | |
|---|---|---|---|
| EP | 1999338 | B1 | 7/2010 |
| EP | 2366056 | B1 | 6/2014 |
| WO | 2009108068 | A1 | 9/2009 |
| WO | 2013159237 | A1 | 10/2013 |
| WO | 2019083922 | A1 | 5/2019 |

OTHER PUBLICATIONS

International Search Report and Written Opinion dated Feb. 16, 2023 in PCT/US2022/046871; 10 pages.
International Search Report and Written Opinion dated Feb. 17, 2023 in PCT/US2022/046868; 11 pages.

* cited by examiner

ELECTRICALLY ACTIVATED WHIPSTOCK INTERFACE SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. A whipstock connector rotationally fixes the window mill relative to the whipstock. The whipstock directs the window mill to form a window or opening in the casing.

Generally, a window milling system is lowered into the borehole to a selected depth. Once in position, an anchor is deployed to lock the whipstock to the casing. Typically, a setting system shifts a slip axially along a tubular. The slip radially expands and bites into the casing. The setting system may take the form of a hydrostatic actuator, a hydraulic actuator, or a mechanical weight set. Once set, there is a need to separate the window mill from the whipstock connector. Separating the components, e.g., the window mill and the whipstock connector often requires the use of hydrostatic actuators, hydraulic actuators, and the like. Separating the components can take time especially when there is a need to build pressure to employ a hydrostatic or hydraulic actuator. Accordingly, operators would welcome a system for more rapidly deploying, set, and disconnect from a whipstock.

SUMMARY

Disclosed, in accordance with a non-limiting example, is a window cutting system including a whipstock connector, and a window mill selectively rotationally constrained to the whipstock connector. The window mill including an outer surface, an inner surface, a passage defined between the outer surface and the inner surface, and a recess formed in the outer surface. A locking pin is arranged in the recess. A motor arranged in the passage. An actuator is operatively connected between the motor and the locking pin. The motor being selectively activated through a signal to retract the locking pin releasing the window mill from the whipstock connector.

Also disclosed, in accordance with a non-limiting example, is a resource exploration and recovery system includes a surface system, a subsurface system operatively connected to the surface system, a window cutting system including a whipstock connector and a window mill selectively rotationally constrained to the whipstock connector. The window mill includes an outer surface, an inner surface, a passage defined between the outer surface and the inner surface, and a recess formed in the outer surface. A locking pin is arranged in the recess. A motor is arranged in the passage. An actuator is operatively connected between the motor and the locking pin. The motor is selectively activated through a signal to retract the locking pin releasing the window mill from the whipstock connector.

Further disclosed, in accordance with a non-limiting example, is a method of deploying a tool in a wellbore including sending a signal along a tubular string extending into a wellbore of the subsurface system, receiving the signal at an electronics package located in a window mill connected with a whipstock connector of a window cutting system connected to the tubular string, activating a motor arranged in the window ill with the signal, and shifting an actuator with the motor to disconnect the window mill and the whip stock connector.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
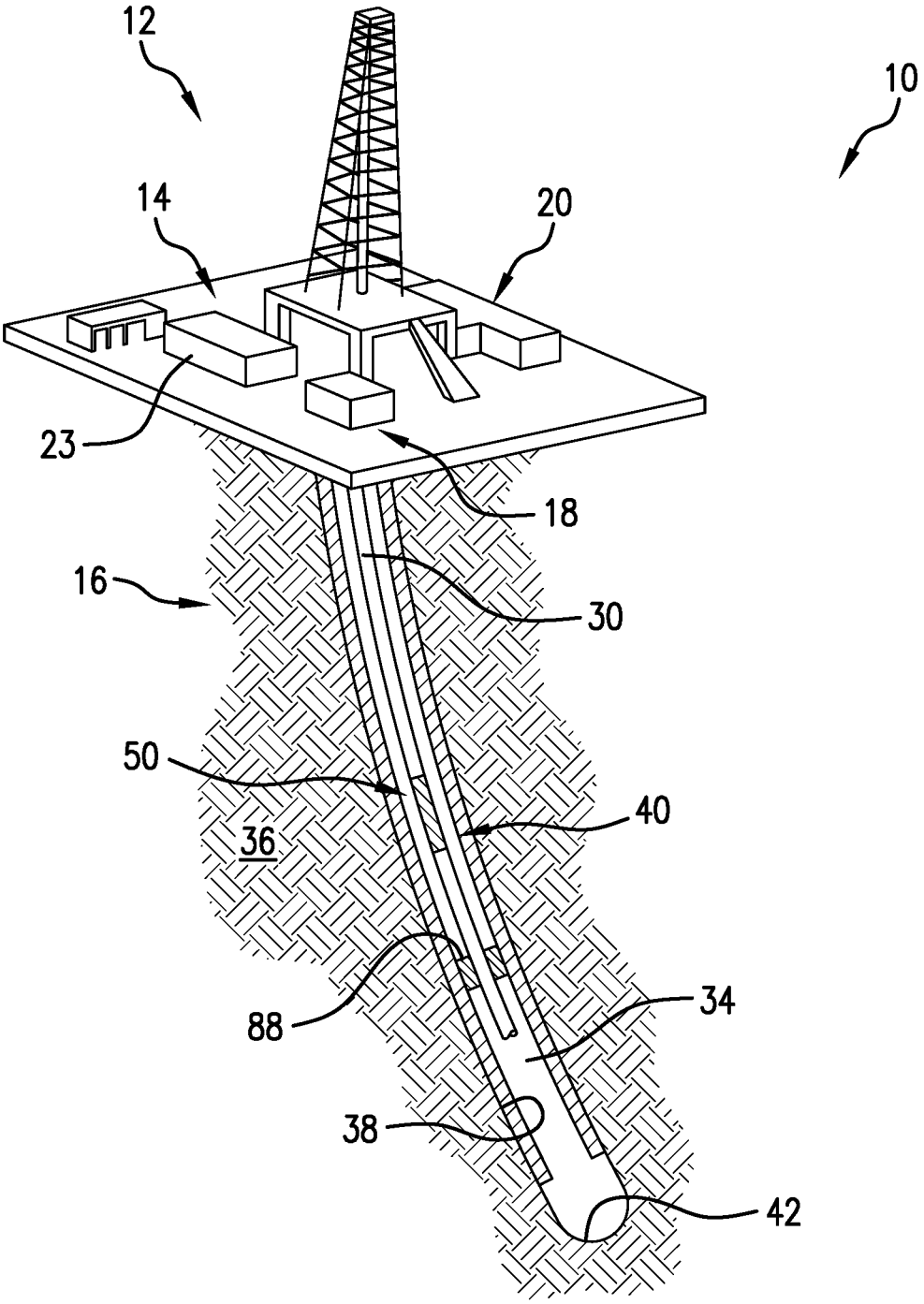
FIG. 1 depicts a resource exploration and recovery system including an electrically activated whipstock interface system, in accordance with a non-limiting example.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
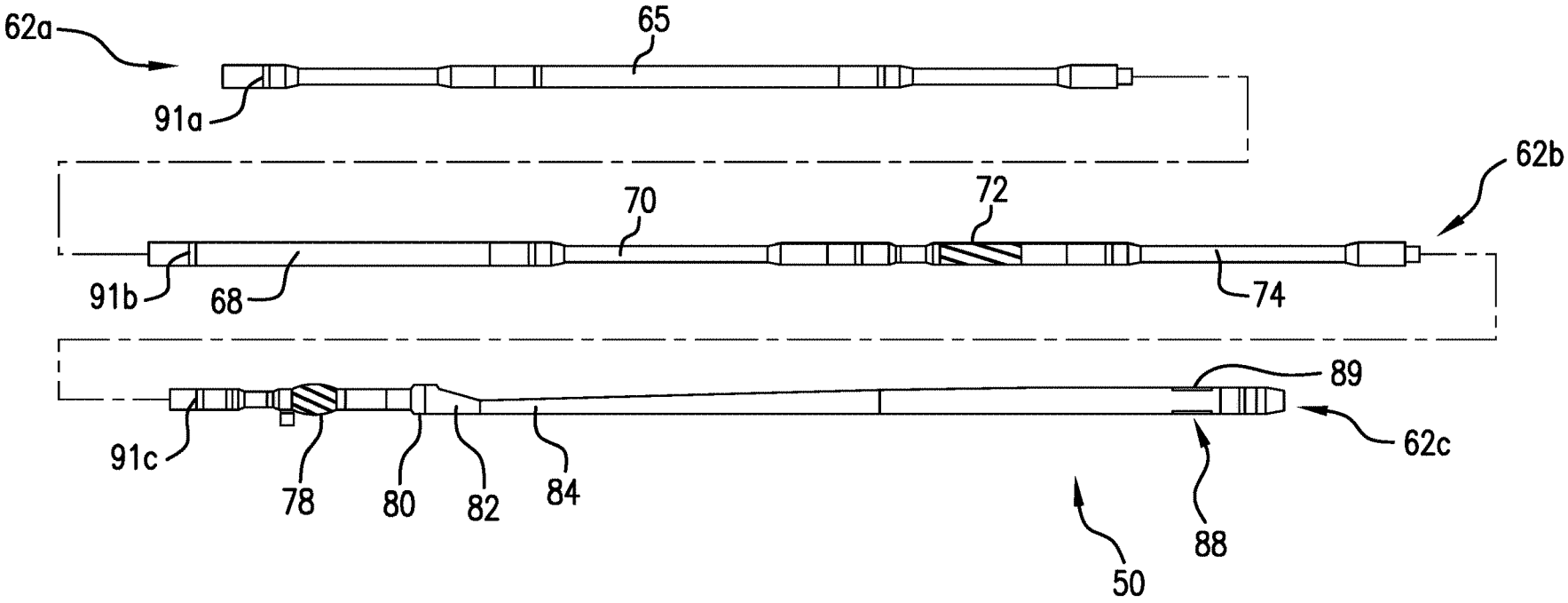
FIG. 2 depicts a work string including the electrically activated whipstock interface system of FIG. 1, in accordance with a non-limiting example.

In accordance with an exemplary aspect, tubular string 30 may support a window cutting system 50 as shown in FIG. 2. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems which monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88 that may include one or more slips 89. Whipstock connector 82 serves as an interface between window mill 80 and whipstock 84. In a non-limiting example, a plurality of wireless repeaters 91*a*, 91*b*, and 91*c* are arranged on corresponding ones of tubular segments 62*a*, 62*b*, and 62*c*. As will be detailed herein, wireless repeaters 91*a*, 91*b*, and 91*c* are coupled to control system 23 and are operable to promulgate a wireless signal along tubular string 30. The wireless signal may take on a variety of forms.

Figure 3:
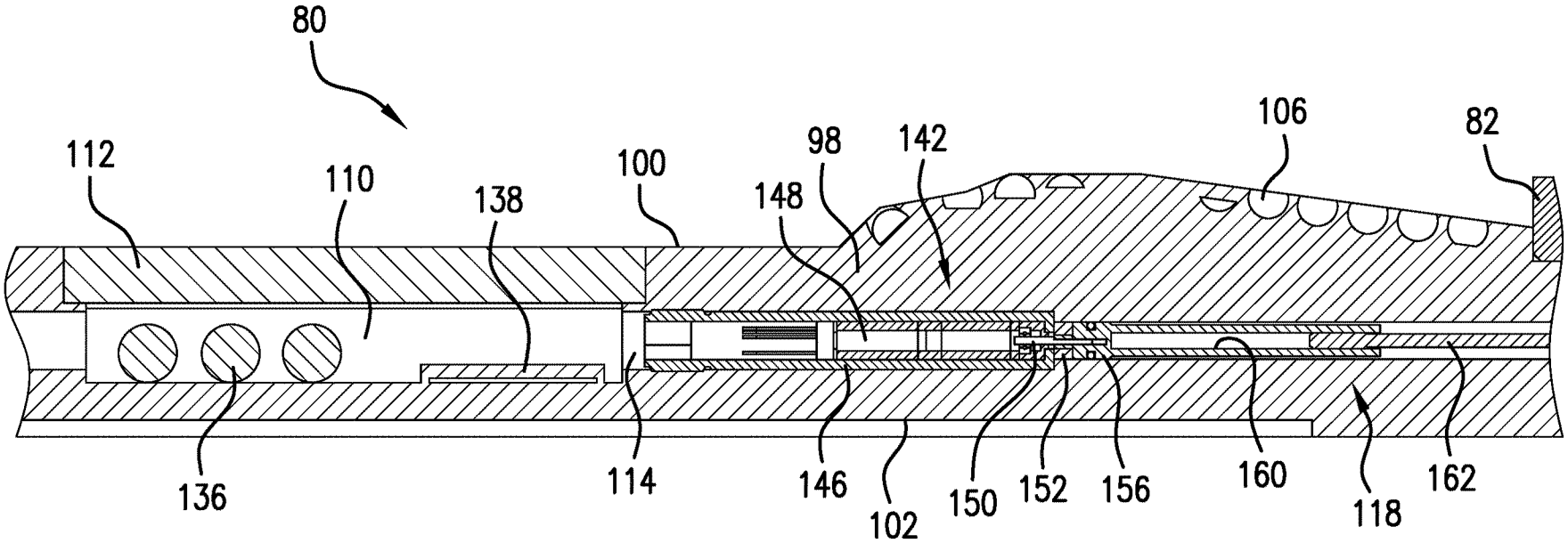
FIG. 3 is a partial cross-sectional side view of a portion of the whipstock interface system, in accordance with a non-limiting example.
Figure 4:
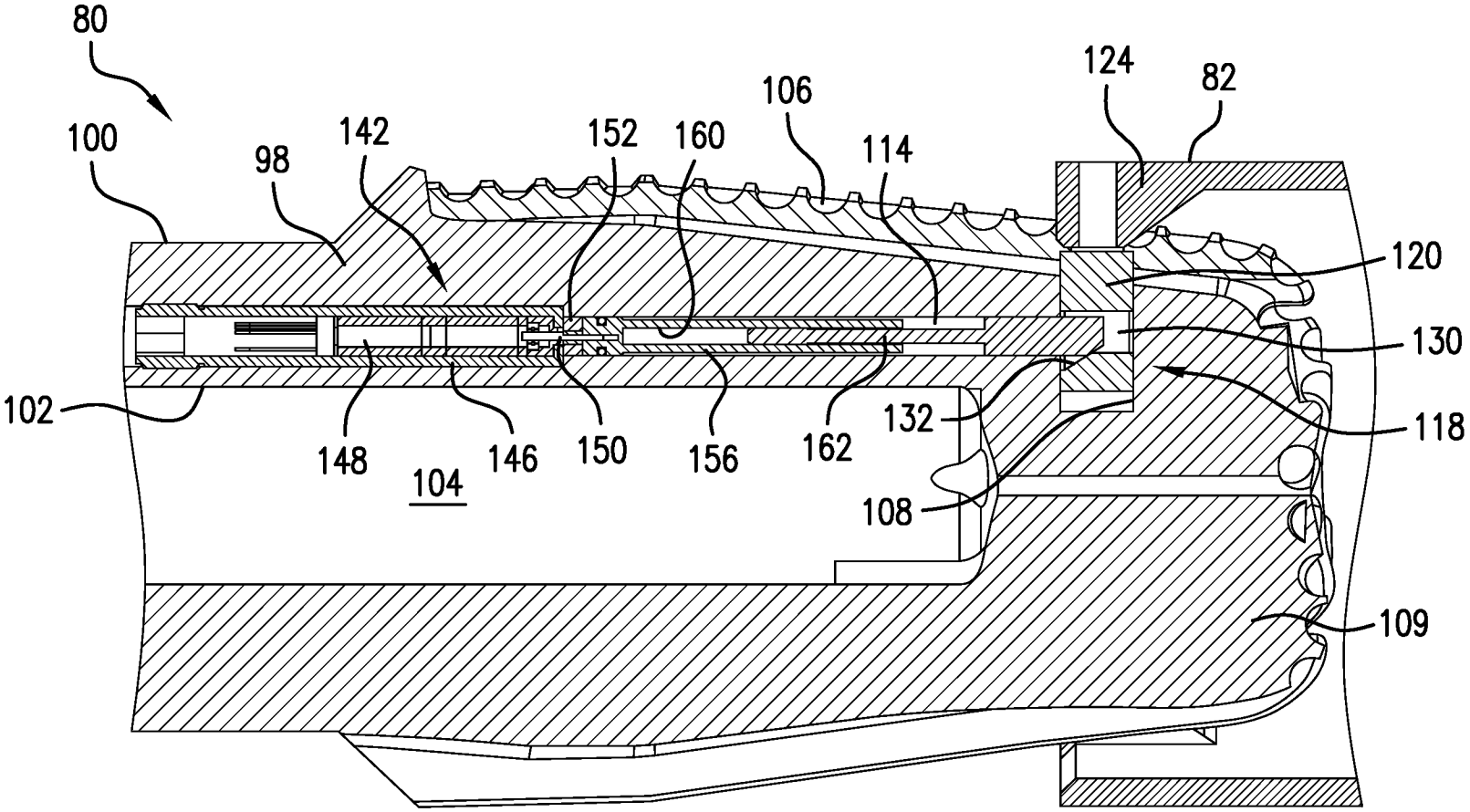
FIG. 4 depicts a cross-section side view of the whipstock interface system arranged in a window mill, in accordance with a non-limiting example.

In a non-limiting example shown in FIGS. 3 and 4, window mill 80 includes a body 98 having an outer surface 100 and an inner surface 102 that may define a conduit 104. A plurality of cutting elements, one of which is indicated at 106, is disposed on outer surface 100. Body 98 includes a recess 108 arranged near a tip portion 109 of window mill 80 and a control compartment 110. Control compartment 110 includes a cover 112 and is axially spaced from recess 108. A passage 114 extends between control compartment 110 and recess 108.

In a non-limiting example, window mill 80 includes a whipstock engagement system 118 including a locking pin 120 is disposed in recess 108. Locking pin 120 engages with one of a plurality of lugs 124 that are provided on and project radially inwardly of whipstock connector 82. Locking pin 120 rotatably fixes window mill 80 to whipstock connector 82. An actuator receiver 130 having an angled surface 132 extends into locking pin 120. Actuator receiver 130 is substantially aligned with passage 114. At this point it should be understood that whipstock engagement system 118 may include a locking pin associated with each of the plurality of lugs 124.

In a non-limiting embodiment, whipstock engagement system 118 includes a battery 136 as well as an electronics package 138 that may include a repeater and/or a wireless receiver (not separately labeled) housed in control compartment 110. Battery 136 powers a motor system 142 of whipstock engagement system 118 disposed in passage 114. In a non-limiting example, motor system 142 takes the form of a wireless motor system. However, it should be understood that the motor system could be connected to a wireline in accordance with another non-limiting example. The wireline could provide command signals and power or, simple a command signal if a battery is provided. It should be understood that the term "wireless motor system" describes a motor system that receives command and control signals through a wireless interface.

Figure 5:
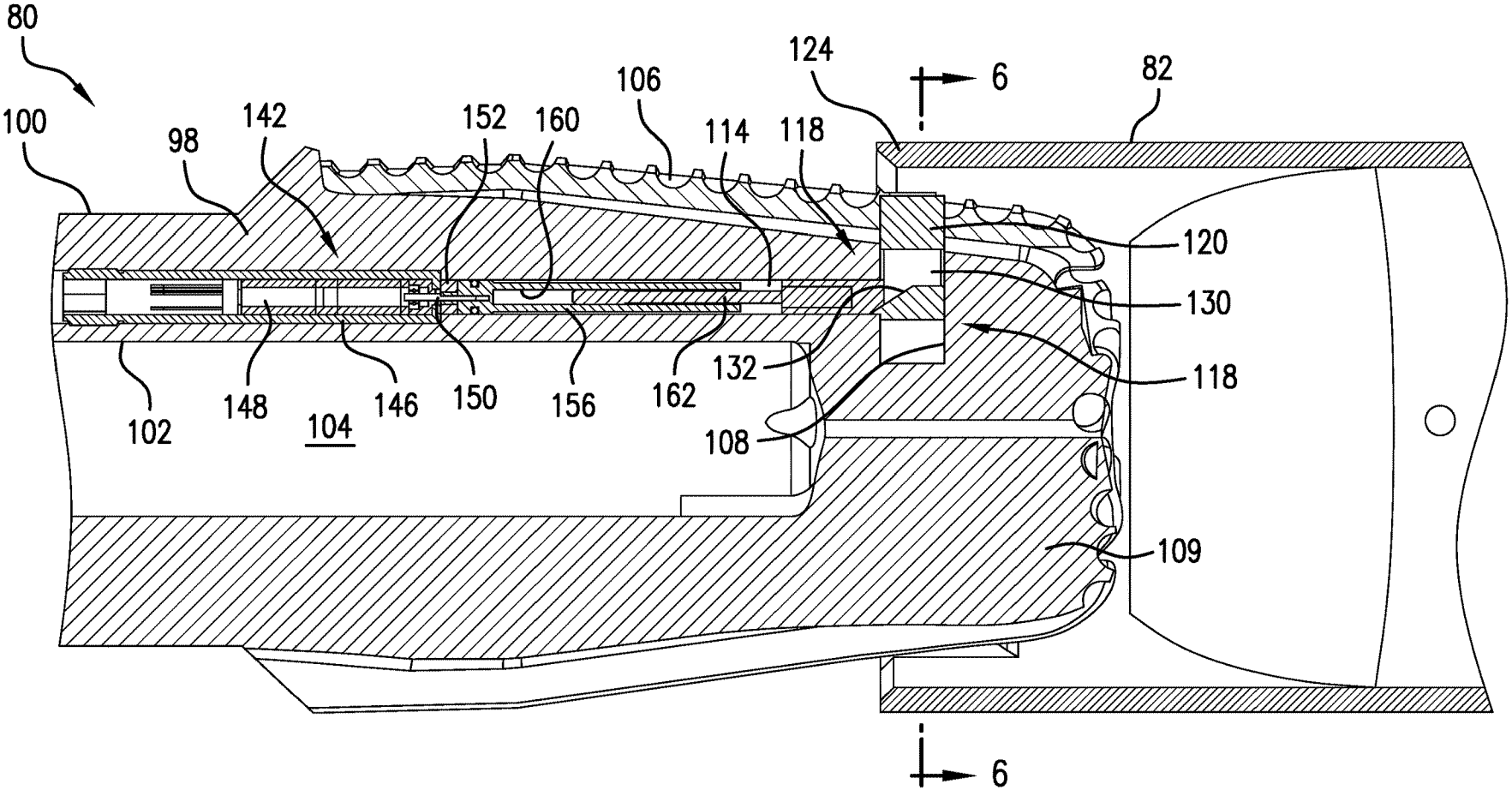
FIG. 5 depicts the whipstock interface system shown connecting the window mill to a whipstock connector, in accordance with a non-limiting example.
Figure 6:
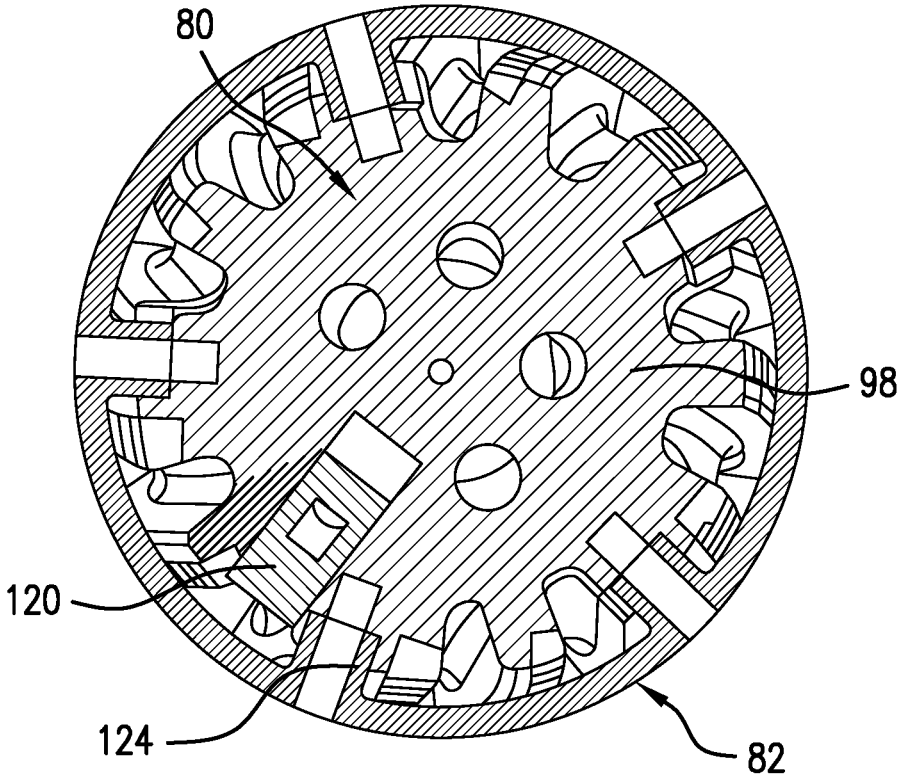
FIG. 6 depicts a cross-sectional axial end view of the window mill of FIG. 5 taken along the line 6-6, in accordance with a non-limiting example.
Figure 7:
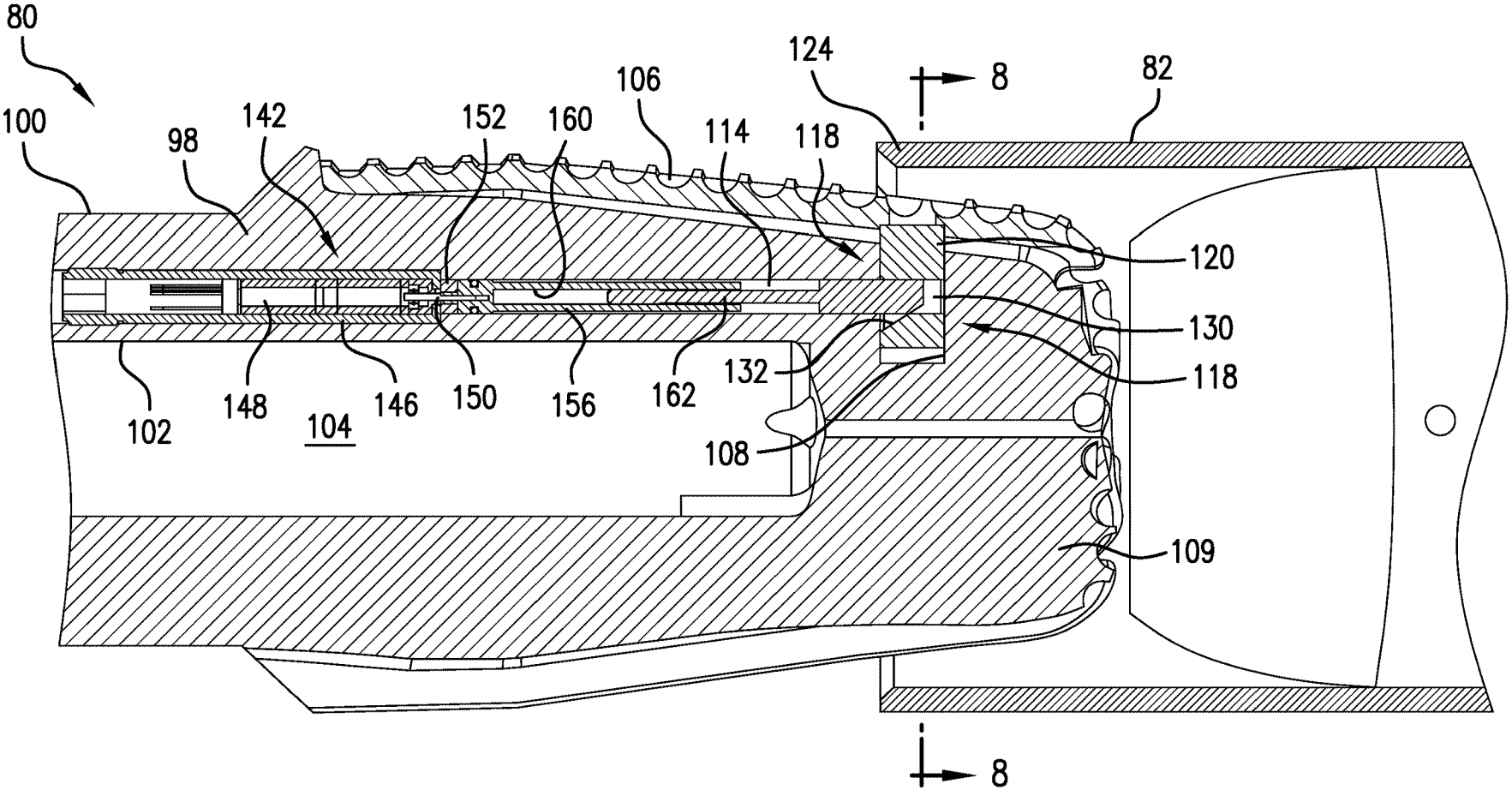
FIG. 7 depicts the whipstock interface system shown disengaging the window mill from the whipstock connector, in accordance with a non-limiting example.
Figure 8:
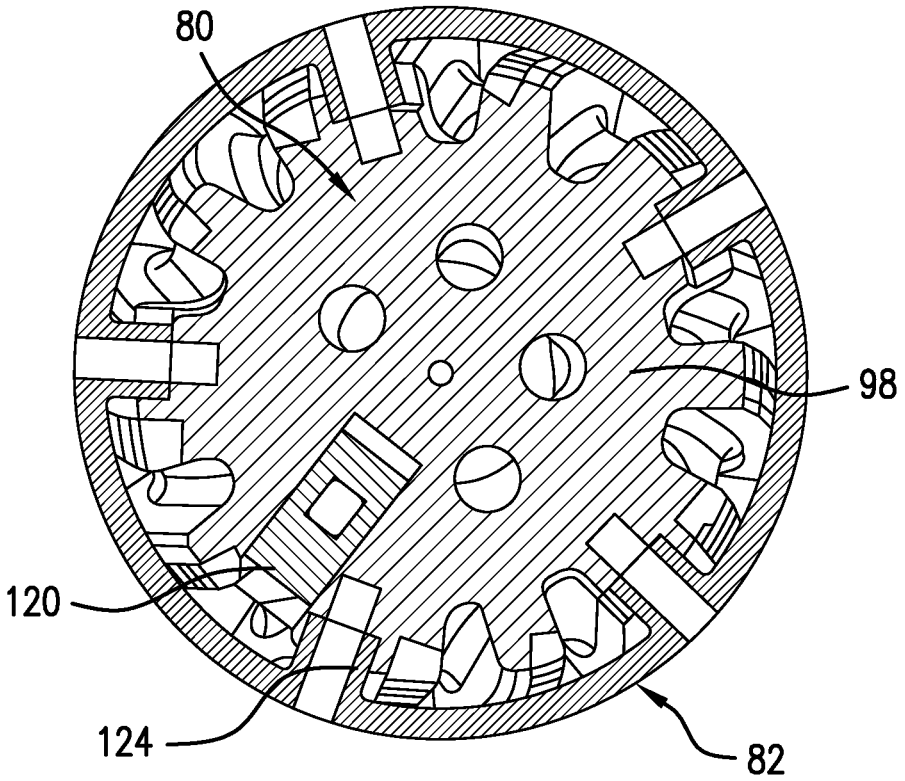
FIG. 8 depicts a cross-sectional axial end view of the window mill of FIG. 7 taken along the line 8-8, in accordance with a non-limiting example.
Figure 9:
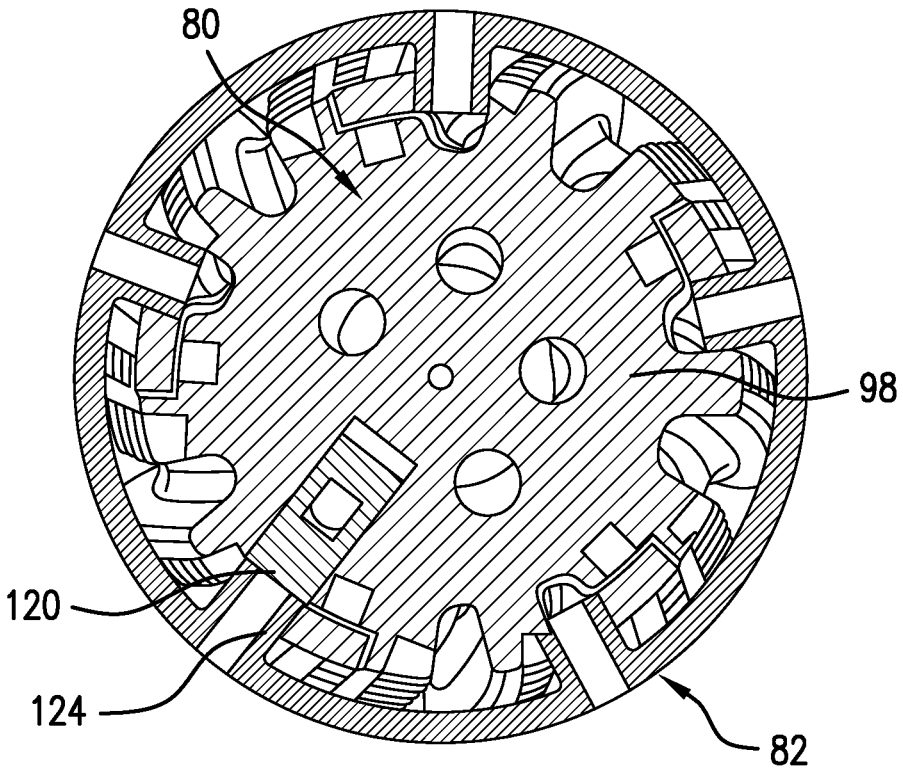
FIG. 9 depicts an axial end view of the window mill of FIG. 8 rotating relative to the whipstock connecter, in accordance with a non-limiting example.
Figure 10:
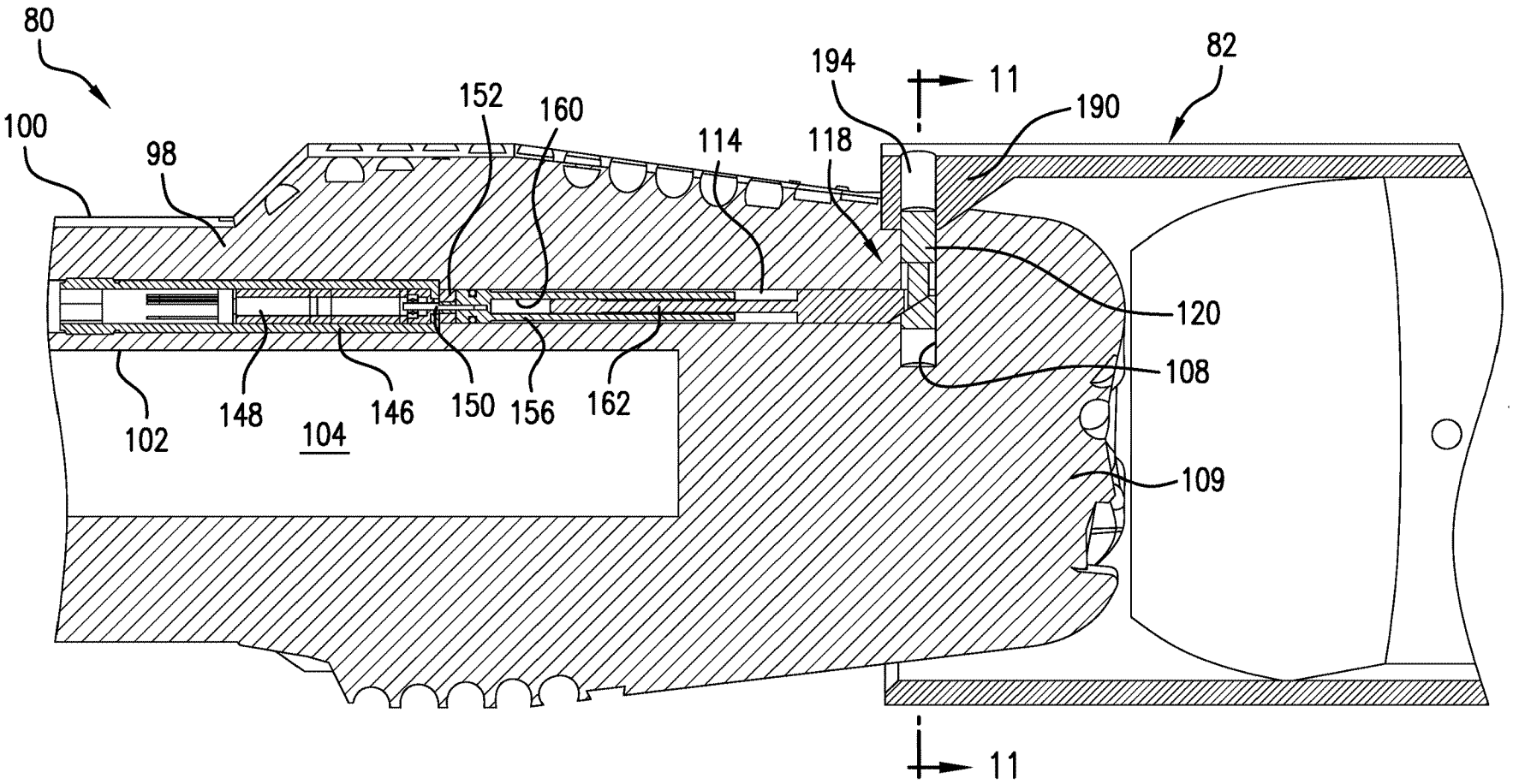
FIG. 10 depicts the whipstock interface system shown connecting the window mill to a whipstock connector, in accordance with another non-limiting example.
Figure 11:
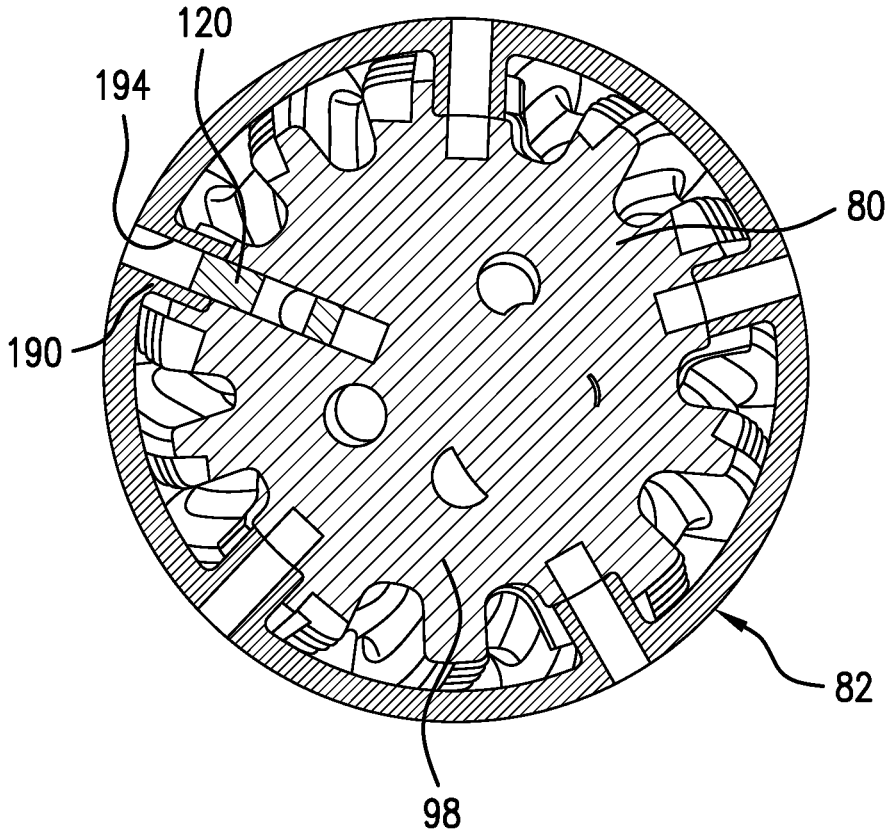
FIG. 11 depicts a cross-sectional axial end view of the window mill of FIG. 10 taken along the line 11-11, in accordance with a non-limiting example.
Figure 12:
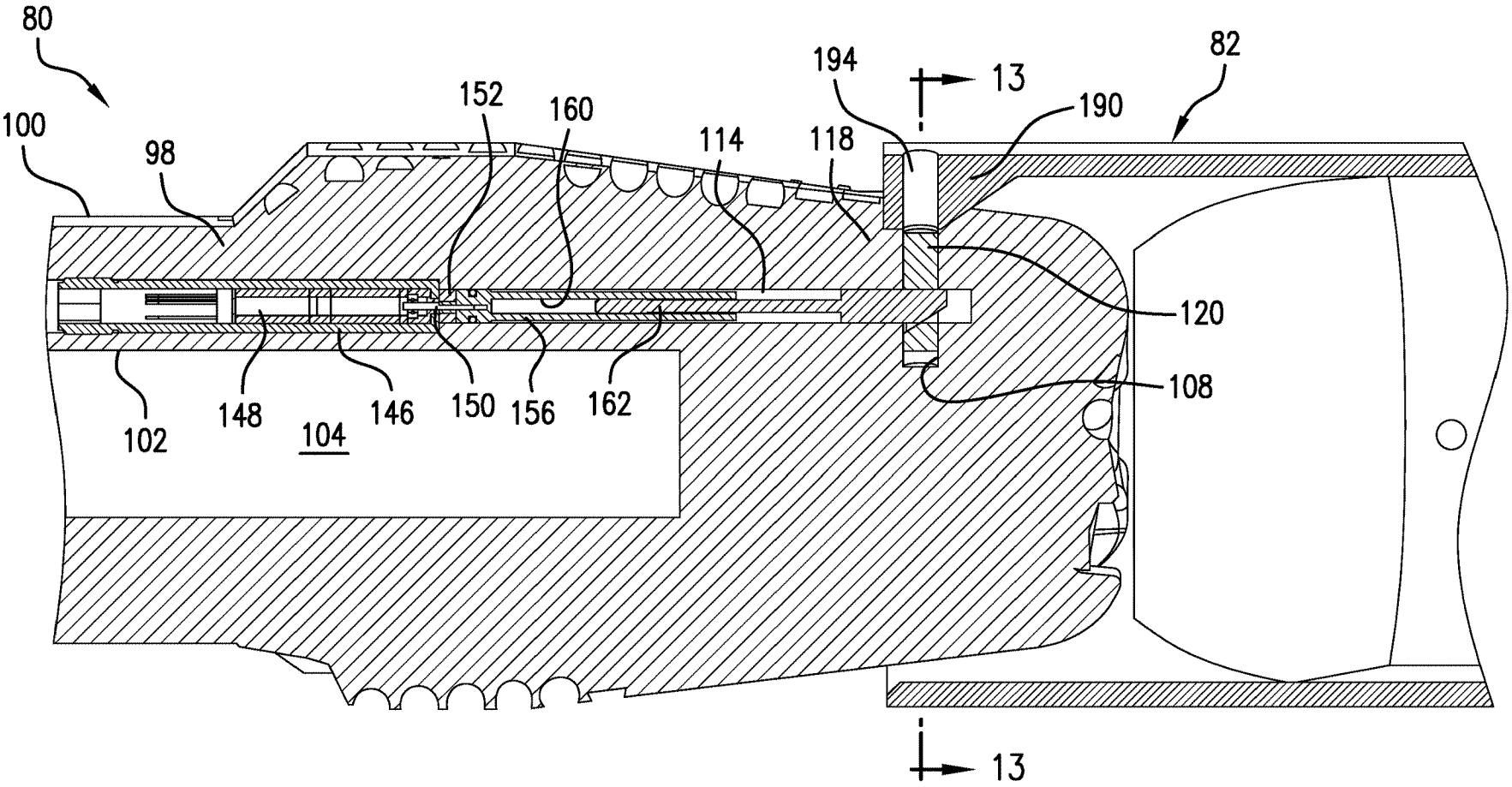
FIG. 12 depicts the whipstock interface system of FIG. 10 shown disengaging the window mill from the whipstock connector, in accordance with a non-limiting example.
Figure 13:
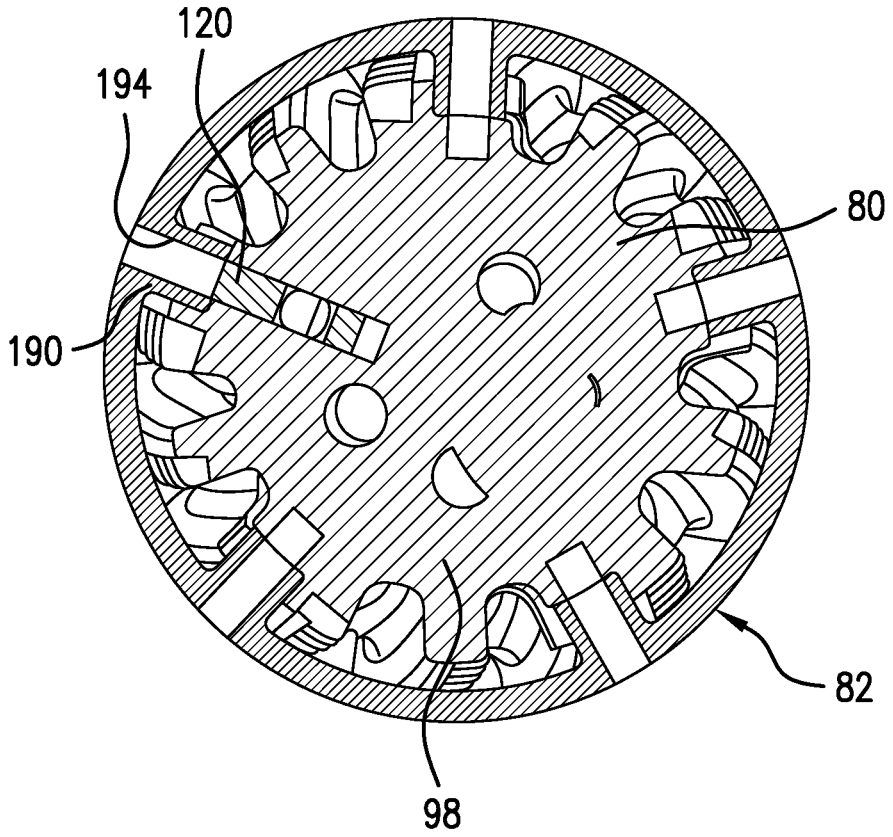
FIG. 13 depicts a cross-sectional axial end view of the window mill of FIG. 12 taken along the line 12-12, in accordance with a non-limiting example.

Electronics package 138 includes a wireless receiver (not separately labeled) and provides an interface between battery 136, wireless repeaters 91*a*, 91*b*, and 91*c* and a wireless motor system 142 to selectively shift locking pin 120. Locking pin 120 shifts from a deployed configuration (FIGS. 5 and 6) to a retracted configuration (FIGS. 7 and 8) so that window mill 80 may move either through rotation or axially shifting and disengage from whipstock connector 82 as shown in FIG. 9. Once disengaged, window mill 80 may be operated to form a window or opening in casing tubular 40 and begin to form a branch (not shown) from wellbore 34. At this point, it should be understood, that electronics package 138 may communicate with wireless motor system 142 through either a wired or a wireless connection.

In a non-limiting example, wireless motor system 142 includes a sleeve 146 disposed in passage 114. A wireless motor system 142, having an output shaft 150, is disposed within sleeve 146. Output shaft 150 is supported in passage 114 by a thrust bearing 152. A drive shaft 156 is connected to output shaft 150. Drive shaft 156 is axially fixed yet rotatable within passage 114. Drive shaft 156 includes an internally threaded passage 160. An actuator 162 extends into internally threaded passage 160 and is connected to drive shaft 177. Actuator 162 is externally threaded and connects with drive shaft 156 through a threaded connection.

In a non-limiting example, actuator 162 retracts locking pin 120 into window mill 80. In this manner, locking pin 120 disengages from a corresponding one of lugs 124. That is, locking pin 120, in one non-limiting example, extends into a gap (not separately labeled) between lugs 124 to constrain window mill 80 relative to whipstock connector 82. In another non-limiting example depicted in FIGS. 10-13, whipstock connector 82 may include lugs 190 having a locking pin receiver 194. With such an arrangement, locking pin 120 can extend into lug 190 to constrain window mill 80 relative to whipstock connector 82.

At this point, it should be understood that while shown as shifting a single locking pin 120 relative to one lug, whipstock engagement system 118 may shift multiple locking pins relative to multiple lugs so as to release window mill 80 from whipstock connector 82. It should also be understood that whip stock engagement system 118 including all electronic components may be removed from the wellbore at the completion of a casing exist procedure. That is, the electronics may be withdrawn from the wellbore with the window mill.

Figure 14:
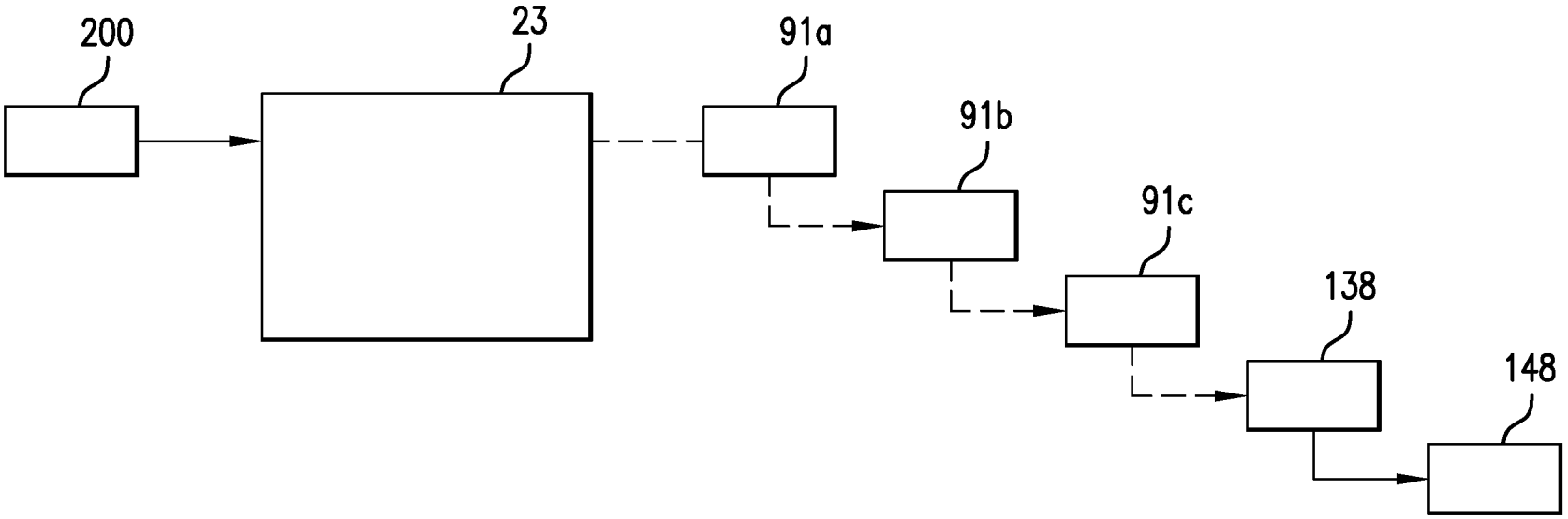
FIG. 14 depicts a block diagram illustrating a control scheme for the window mill interface system, in accordance with a non-limiting example.

In a non-limiting example, an activator 200 shown in FIG. 14 may be engaged to deliver a wireless signal along repeaters 91*a*, 91*h*, and 91*c* into electronics 138 to activate wireless motor 148. When rotated in a first direction, output shaft 150 drives actuator 162 to move into window mill 80 along angled surface 132. As actuator 162 transitions out from actuator receiver 130, locking pin 120 disengages from lug 124 allowing window mill 80 to rotate relative to whipstock connector 82. The use of wireless signals significantly reduces the time needed to disengage the window mill from the whipstock connector so as to reduce downtime and allow operators to quickly form a window once window cutting system 50 is deployed and in position. Further, by retracting the pins, the window mill can be simply pulled away from the whipstock connector without the need for rotation or other complex manipulations that are difficult to perceive at the surface.

Set forth below are some embodiments of the foregoing disclosure:

Embodiment 1. A window cutting system comprising: a whipstock connector; a window mill selectively rotationally constrained to the whipstock connector, the window mill including an outer surface, an inner surface, a passage defined between the outer surface and the inner surface, and a recess formed in the outer surface; a locking pin arranged in the recess; a motor arranged in the passage; and an actuator operatively connected between the motor and the locking pin, the motor being selectively activated through a signal to retract the locking pin releasing the window mill from the whipstock connector.

Embodiment 2. The window cutting system according to any prior embodiment, wherein the motor comprises a wireless motor.

Embodiment 3. The window cutting system according to any prior embodiment, wherein the window mill includes a controls compartment housing a battery and an electronics package operatively connected to the wireless motor.

Embodiment 4. The window cutting system according to any prior embodiment, further comprising: a selectively removeable cover arranged over the controls compartment, wherein the battery, electronics, and wireless motor are accessible through the cover.

Embodiment 5. The window cutting system according to any prior embodiment, wherein the electronics package includes a wireless receiver operatively connected to the wireless motor.

Embodiment 6. The window cutting system according to any prior embodiment, further comprising: a tubular string including a first end, a second end, and an intermediate portion extending between the first end and the second end, the window mill being connected to the tubular string; and a plurality of wireless signal repeaters arranged along the intermediate portion of the tubular string, the plurality of wireless repeaters being operatively connected with the wireless receiver in the controls compartment.

Embodiment 7. The window cutting system according to any prior embodiment, wherein the locking pin includes an actuator receiver having an angled surface, the actuator being selectively shifted along the angled surface to retract the locking pin.

Embodiment 8. The window cutting system according to any prior embodiment, wherein the whipstock connector includes a plurality of lugs, wherein the locking pin selectively engages one of the plurality of lugs to rotationally fix the window mill relative to the whipstock connector.

Embodiment 9. The window cutting system according to any prior embodiment, wherein the locking pin selectively extends into one of the plurality of lugs to rotationally fix the window mill relative to the whipstock connector.

Embodiment 10. A resource exploration and recovery system comprising: a surface system; a subsurface system operatively connected to the surface system; and a window cutting system comprising: a whipstock connector; a window mill selectively rotationally constrained to the whipstock connector, the window mill including an outer surface, an inner surface, a passage defined between the outer surface and the inner surface, and a recess formed in the outer surface; a locking pin arranged in the recess; a motor arranged in the passage; and an actuator operatively connected between the motor and the locking pin, the motor being selectively activated through a signal to retract the locking pin releasing the window mill from the whipstock connector.

Embodiment 11. The resource exploration and recovery system according to any prior embodiment, wherein the motor comprises a wireless motor.

Embodiment 12. The resource exploration and recovery system according to any prior embodiment, wherein the window mill includes a controls compartment housing a battery and electronics operatively connected to the wireless motor.

Embodiment 13. The resource exploration and recovery system according to any prior embodiment, further comprising: a selectively removeable cover arranged over the controls compartment, wherein the battery, electronics, and wireless motor are accessible through the cover.

Embodiment 14. The resource exploration and recovery system according to any prior embodiment, wherein the electronics package includes a wireless receiver operatively connected to the wireless motor.

Embodiment 15. The resource exploration and recovery system according to any prior embodiment, further comprising: a tubular string supporting the window cutting system, the tubular string including a first end, a second end, and an intermediate portion extending between the first end and the second end, the window mill being connected to the tubular string; and a plurality of wireless signal repeaters arranged along the intermediate portion of the tubular string, the plurality of wireless repeaters being operatively connected with the wireless receiver in the controls compartment.

Embodiment 16. The resource exploration and recovery system according to any prior embodiment, wherein the locking pin includes an actuator receiver having an angled surface, the actuator being selectively shifted along the angled surface to retract the locking pin.

Embodiment 17. The resource exploration and recovery system according to any prior embodiment, wherein the whipstock connector includes a plurality of lugs, wherein the locking pin selectively engages one of the plurality of lugs to rotationally fix the window mill relative to the whipstock connector.

Embodiment 18. The resource exploration and recovery system according to any prior embodiment, wherein the locking pin selectively extends into one of the plurality of lugs to rotationally fix the window mill relative to the whipstock connector.

Embodiment 19. A method of deploying a tool in a wellbore comprising: sending a signal along a tubular string extending into a wellbore of the subsurface system; receiving the signal at an electronics package located in a window mill connected with a whipstock connector of a window cutting system connected to the tubular string; activating a motor arranged in the window mill with the signal; and shifting an actuator with the motor to disconnect the window mill and the whip stock connector.

Embodiment 20. The method according to any prior embodiment, wherein shifting the actuator includes retracting a locking pin that selectively rotationally constricts the window mill to the whipstock connector.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A window cutting system comprising:

a whipstock connector;

a window mill selectively rotationally constrained to the whipstock connector, the window mill including an outer surface, an inner surface, a passage defined between the outer surface and the inner surface, and a recess formed in the outer surface;

a locking pin arranged in the recess;

a motor arranged in the passage within the window mill; and an actuator arranged within the window mill and operatively connected between the motor and the locking pin, the motor being selectively activated through a signal to retract the locking pin releasing the window mill from the whipstock connector.

2. The window cutting system according to claim 1, wherein the motor comprises a wireless motor.

3. The window cutting system according to claim 2, wherein the window mill includes a controls compartment housing a battery and an electronics package operatively connected to the wireless motor.

4. The window cutting system according to claim 3, further comprising: a selectively removeable cover arranged over the controls compartment, wherein the battery, electronics, and wireless motor are accessible through the cover.

5. The window cutting system according to claim 3, wherein the electronics package includes a wireless receiver operatively connected to the wireless motor.

6. The window cutting system according to claim 5, further comprising:

a tubular string including a first end, a second end, and an intermediate portion extending between the first end and the second end, the window mill being connected to the tubular string; and a plurality of wireless signal repeaters arranged along the intermediate portion of the tubular string, the plurality of wireless repeaters being operatively connected with the wireless receiver in the controls compartment.

7. The window cutting system according to claim 1, wherein the locking pin includes an actuator receiver having an angled surface, the actuator being selectively shifted along the angled surface to retract the locking pin.

8. The window cutting system according to claim 1, wherein the whipstock connector includes a plurality of lugs, wherein the locking pin selectively engages one of the plurality of lugs to rotationally fix the window mill relative to the whipstock connector.

9. The window cutting system according to claim 8, wherein the locking pin selectively extends into one of the plurality of lugs to rotationally fix the window mill relative to the whipstock connector.

10. A resource exploration and recovery system comprising:

a surface system;

a subsurface system operatively connected to the surface system; and a window cutting system comprising:

a whipstock connector;

a window mill selectively rotationally constrained to the whipstock connector, the window mill including an outer surface, an inner surface, a passage defined between the outer surface and the inner surface, and a recess formed in the outer surface;

a locking pin arranged in the recess;

a motor arranged in the passage within the window mill; and an actuator arranged within the window mill and operatively connected between the motor and the locking pin, the motor being selectively activated through a signal to retract the locking pin releasing the window mill from the whipstock connector.

11. The resource exploration and recovery system according to claim 10, wherein the motor comprises a wireless motor.

12. The resource exploration and recovery system according to claim 11, wherein the window mill includes a controls compartment housing a battery and electronics operatively connected to the wireless motor.

13. The resource exploration and recovery system according to claim 12, further comprising: a selectively removeable cover arranged over the controls compartment, wherein the battery, electronics, and wireless motor are accessible through the cover.

14. The resource exploration and recovery system according to claim 12, wherein the electronics package includes a wireless receiver operatively connected to the wireless motor.

15. The resource exploration and recovery system according to claim 14, further comprising:

a tubular string supporting the window cutting system, the tubular string including a first end, a second end, and an intermediate portion extending between the first end and the second end, the window mill being connected to the tubular string; and a plurality of wireless signal repeaters arranged along the intermediate portion of the tubular string, the plurality of wireless repeaters being operatively connected with the wireless receiver in the controls compartment.

16. The resource exploration and recovery system according to claim 10, wherein the locking pin includes an actuator receiver having an angled surface, the actuator being selectively shifted along the angled surface to retract the locking pin.

17. The resource exploration and recovery system according to claim 10, wherein the whipstock connector includes a plurality of lugs, wherein the locking pin selectively engages one of the plurality of lugs to rotationally fix the window mill relative to the whipstock connector.

18. The resource exploration and recovery system according to claim 17, wherein the locking pin selectively extends into one of the plurality of lugs to rotationally fix the window mill relative to the whipstock connector.

19. A method of deploying a tool in a wellbore comprising:

sending a signal along a tubular string extending into a wellbore of the subsurface system;

receiving the signal at an electronics package located within in a window mill connected with a whipstock connector of a window cutting system connected to the tubular string;

activating a motor arranged within the window mill with the signal; and shifting an actuator arranged within the window mill with the motor to disconnect the window mill and the whip stock connector.

20. The method of claim 19, wherein shifting the actuator includes retracting a locking pin that selectively rotationally constricts the window mill to the whipstock connector.

* * * * *